United States Patent [19]

Iwata et al.

[11] Patent Number: 4,657,189

[45] Date of Patent: Apr. 14, 1987

[54] ELECTROMAGNETIC FUEL INJECTION VALVE FOR AN INTERNAL COMBUSTION ENGINE HAVING A PLURALITY OF INTAKE VALVES

[75] Inventors: Minoru Iwata, Susono; Shigetaka Takada, Oobu; Hitoshi Takeuchi, Chita, all of Japan

[73] Assignees: Aisan Kogyo Kabushiki Kaisha; Toyota Jidosha Kabushiki Kaisha, both of Aichi, Japan

[21] Appl. No.: 838,290

[22] Filed: Mar. 10, 1986

[30] Foreign Application Priority Data

| | | | |
|---|---|---|---|
| Mar. 13, 1985 | [JP] | Japan | 60-34717[U] |
| Jun. 25, 1985 | [JP] | Japan | 60-95151[U] |
| Aug. 2, 1985 | [JP] | Japan | 60-118105[U] |

[51] Int. Cl.[4] ..... F02M 51/06

[52] U.S. Cl. ..... 239/585; 239/533.12

[58] Field of Search ..... 239/533.2–533.12, 239/553, 585

[56] References Cited

FOREIGN PATENT DOCUMENTS

| | | | |
|---|---|---|---|
| 866574 | 2/1953 | Fed. Rep. of Germany | 239/533.4 |
| 151986 | 11/1981 | Fed. Rep. of Germany | 239/533.3 |
| 52-170123 | 6/1977 | Japan . | |
| 2073954 | 10/1981 | United Kingdom | 239/585 |

*Primary Examiner*—Andres Kashnikow

*Attorney, Agent, or Firm*—Kenyon & Kenyon

[57] ABSTRACT

An electromagnetic fuel injection valve for an internal combustion engine having a valve body with a single fuel injection hole and a plurality of injected fuel paths. A meeting portion of the injected fuel paths is provided downstream of the fuel injection hole and upstream of the injected fuel paths. A wall of the meeting portion is formed to have an inner transverse dimension not smaller than a total corresponding transverse dimension of walls of the injected fuel paths. An injected fuel dividing portion provided below the fuel injection hole has an upwardly facing sharp edge. These structures enable a smooth flow and a smooth division of the injected fuel. Desirably, a length (L) of the injected fuel paths, an equivalent diameter (Di) of the injected fuel path, a diameter (d) of the fuel injection hole and a number (n) of the injected fuel paths have the following relationships:

$$30 \geqq n(Di/d)^2 \geqq 20$$

$$3 \geqq L/Di \geqq 1$$

Also desirably, an angle made in a bottom surface of the meeting portion is set not larger than twice the angle, with respect to the horizontal, at which the fuel injection valve is mounted on the internal combustion engine.

7 Claims, 20 Drawing Figures

ELECTROMAGNETIC FUEL INJECTION VALVE FOR AN INTERNAL COMBUSTION ENGINE HAVING A PLURALITY OF INTAKE VALVES

BACKGROUND OF THE INVENTION

1. Field of the Invention

The present invention relates to an electromagnetic fuel injection valve used in an internal combustion engine having a plurality of intake valves.

2. Description of the Prior Art

In an internal combustion engine having a plurality of intake valves and an engine intake path with a plurality of divided path portions divided by a dividing wall at the vicinity of the intake valves, fuel must be injected into each of the divided path portions of the intake path.

If an electromagnetic fuel injection valve is installed in each divided path portion to inject fuel into the divided path portion, a plurality of fuel injection valves are needed, resulting in increased cost.

To eliminate one fuel injection valve, Japanese Utility Model Publication No. SHO 52-170123 discloses a fuel injection valve having a plurality of fuel injection holes therein as a valve for injecting fuel into two divided path portions of an engine intake path. In the fuel injection valve, fuel is metered by each fuel injection hole. Therefore, the fuel injection holes must be accurately machined to a specified diameter in order to make accurate metering of the fuel possible. Such accurate machining of each fuel injection hole needs skill and a machining time more than twice the time required for a conventional fuel injection valve having a single fuel injection hole, inevitably resulting in a cost increase.

SUMMARY OF THE INVENTION

An object of the present invention is to provide an electromagnetic fuel injection valve which, in spite of having a single fuel injection hole for metering fuel, can smoothly inject accurately metered fuel by delivering fuel through the fuel injection hole into a plurality of divided path portions of an engine intake path of an internal combustion engine having a plurality of intake valves.

Another object of the present invention is, in a fuel injection valve with a single fuel injection hole, to let fuel delivering from the fuel injection hole be smoothly divided and flow into the divided path portions of the engine intake path, without excessively colliding with walls of injected fuel paths and an injected fuel dividing portion, both of which are provided downstream of the fuel injection hole.

Another object of the present invention is, in a fuel injection valve with a single fuel injection hole, to provide dimensional relationships between the fuel injection hole and the injected fuel paths which make an accurate metering of fuel and/or stable fuel injection possible.

According to the present invention, the above objects can be achieved by an electromagnetic fuel injection valve for an internal combustion engine having a single fuel injection hole for metering fuel to be injected and a plurality of injected fuel paths provided downstream of the fuel injection hole. The injected fuel paths are inclined from an axis of the fuel injection valve, and each injected fuel path is adapted to have a constant cross section over its entire length. An injected fuel dividing portion is provided below the fuel injection hole and has an upstream facing sharp edge which is formed by the intersection of walls of the injected fuel paths. A meeting portion of the injected fuel paths, which meeting portion is located downstream of the fuel injection hole and upstream of the injected fuel dividing portion, is formed to have a constant cross section having an axis common with the fuel injection valve and including the cross section of every injected fuel path therein. A wall of the meeting portion is formed to have an inner transverse dimension not smaller than a total corresponding transverse dimension of the injected fuel paths.

Desirably, the length (L) of each injected fuel path, the equivalent diameter (Di) of each injected fuel path, the diameter (d) of the fuel injection hole and the number of the injected fuel paths (n) have the following relationships:

$$30 \geqq n(Di/d)^2 \geqq 20$$

$$3 \geqq L/Di \geqq 1$$

Also desirably, an angle made in a bottom surface of the meeting portion of the injected fuel paths is set not larger than the angle, to the horizontal, at which the fuel injection valve is mounted on the internal combustion engine.

In the fuel injection valve thus constituted, since the wall of the meeting portion is formed to have an inner transverse dimension not smaller than the total corresponding transverse dimension of the injected fuel paths, the protrusion of the wall below the fuel injection hole, which would appear at the intersection of the walls of the injected fuel paths if the meeting portion was not formed in the above-mentioned manner, is eliminated, and the fuel injected from the fuel injection hole does not collide with such a protrusion. Also, since the meeting portion is located upstream of the injected fuel dividing portion and therefore the injected fuel dividing portion can have a sharp edge, the fuel injected from the fuel injection hole does not collide with a flat plane, which would otherwise appear at the top of the fuel dividing portion if machining of the meeting portion interferes with the fuel dividing portion. Therefore, the fuel can smoothly be divided by the sharp injected fuel dividing portion.

With respect to the relationship between the length (L) of the injected fuel path and the equivalent diameter (Di) of the injected fuel path, if L/Di is too small, that is, the injected fuel path is comparatively short, a spreading angle of the injected fuel is apt to become larger than an aimed angle, because the injected fuel tends not to flow along the wall of the injected fuel dividing portion in such a case. On the contrary, if L/Di is too large, that is, the diameter of the fuel injected path is comparatively small, a flow changing rate of the fuel is apt to become large, because a path with a small diameter becomes a kind of throttle. From these considerations, the relationship of $3 \geqq L/Di \geqq 1$ is determined.

With respect to the relationships among the equivalent diameter (Di) of the injected fuel path, the diameter (d) of the fuel injection hole and the number (n) of the injected fuel paths, the fuel injection changing rate suddenly becomes deteriorated if the fuel injection hole ratio $n(Di/d)^2$ is smaller than 20, and as a result, the fuel injection changing rate exceeds −1%. The reason is that, due to a too small diameter of the injected fuel path, the ambient pressure in the engine intake path is not transmitted to the fuel injection hole, and fuel metering accuracy is impaired under various engine operating conditions.

On the contrary, if $n(Di/d)^2$ is larger than 30, the spreading angle of the injected fuel becomes too large. In the two-way fuel injection valve, fuel can be injected in aimed directions under atmospheric pressure, whereas the fuel injection angle tends to spread, under a high vacuum of, for example, 500 mmHg, because the rate of atomizing the fuel becomes deteriorated. This tendency conspicuously appears in the region where n(Di/d) exceeds 30. From these considerations, the relationship of $30 \geqq n(Di/d)^2 \geqq 20$ is determined. Under the relationship, an optimum metering of fuel with a small fuel injection changing rate and a small injected fuel spreading angle is obtained.

With respect to the relationship between the angle formed in the bottom surface of the meeting portion and the mounting angle of the fuel injection valve, since the former angle is set not larger than the latter angle, the injected fuel does not collect on the bottom surface of the meeting portion and a sudden blowing-out of standing fuel into the engine intake path does not occur. As a result, stable fuel injection and a constant air/fuel ratio of intake gas can be obtained.

BRIEF DESCRIPTION OF THE DRAWINGS

The above and other objects, features and advantages of the present invention will become apparent and more readily appreciated from the following detailed description of the preferred exemplary embodiments of the invention taken in conjunction with the accompanying drawings, in which.

DETAILED DESCRIPTION OF THE PREFERRED EMBODIMENTS

FIGS. 1 to 7 show one embodiment of an electromagnetic fuel injection valve in accordance with the present invention.

Figure 6:
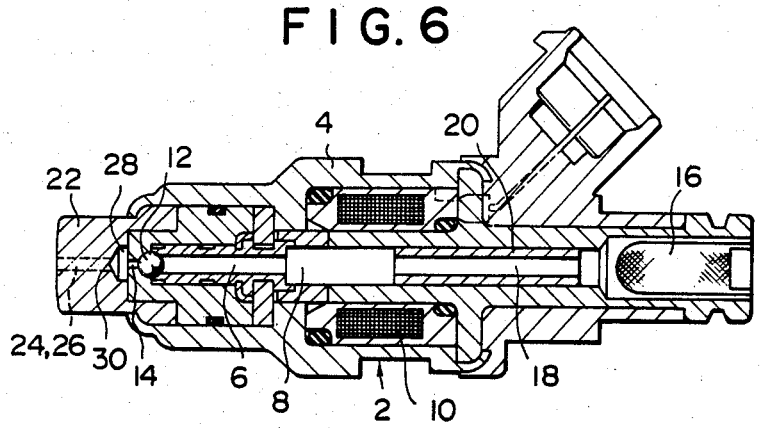
FIG. 6 is an entire sectional view on a smaller scale of the electromagnetic fuel injection valve in accordance with the present invention.
Figure 7:
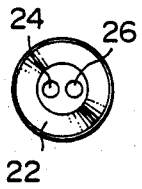
FIG. 7 is an end view of the fuel injection valve of FIG. 6.

FIGS. 6 and 7 show the entire structure of the electromagnetic fuel injection valve. In FIGS. 6 and 7, a fuel injection valve 2 is installed just upstream of a dividing wall provided in an intake path of an internal combustion engine having a plurality of intake valves, so that the fuel injection valve injects fuel into a plurality of intake path portions separated by the dividing wall. A valve body 4 holds a needle 6 therein which can move axially. Needle 6 is driven by a core 8 which is actuated by a solenoid 10. Needle 6 opens or closes, via a ball 12, a single fuel injection hole 14 which is provided in one end of valve body 4. Fuel is supplied via a filter 16 through a fuel supply path 18 in a pipe 20 to fuel injection hole 14. Fuel injection hole 14 is accurately machined to be able to meter a specified volume of fuel to be injected.

An adapter 22 is fixed to an end of valve body 4. In adapter 22, a plurality (for example, two) of injected fuel paths 24 and 26 are formed with an inclination angle $\alpha/2$ to an axis of fuel injection valve 2, respectively. Each injected fuel path 24 or 26 extends straight and has a constant cross section over its entire length. In this connection, injected fuel paths 24 and 26 have a constant cross sectional area, but the shape of the cross section is arbitrary, that is, is not restricted to a circular cross section.

A plurality of injected fuel paths 24 and 26 meet together at their upstream portions and form a meeting portion 28. Meeting portion 28 has an axis common with the axis of fuel injection valve 2 and is located just downstream of fuel injection hole 14. Walls of a plurality of injected fuel paths 24 and 26 intersect and form an injected fuel dividing portion 30. Injected fuel dividing portion 30 is located below fuel injection hole 14 and divides the fuel which has been injected from fuel injection hole 14 into a plurality of injected fuel paths 24 and 26. Injected fuel dividing portion 30 has an upwardly facing sharp edge that is curved in the longitudinal direction. Both longitudinal ends of injected fuel dividing portion 30 terminate at a bottom surface of meeting portion 28. Meeting portion 28 of injected fuel paths 24 and 26 is located upstream of injected fuel dividing portion 30 and, as was previously mentioned, downstream of fuel injection hole 14.

Meeting portion 28 of injected fuel paths 24 and 26 has a constant cross section over its entire length and includes the cross sections of every injected fuel path 24 ahd 26 therein. A wall of meeting portion 28 of injected fuel paths 24 and 26 is formed to have an inner transverse dimension D neither smaller than a total corresponding transverse dimension H of walls of a plurality of injected fuel paths 24 and 26 nor smaller than an inner diameter Di of injected fuel paths 24 and 26.

Figure 2:
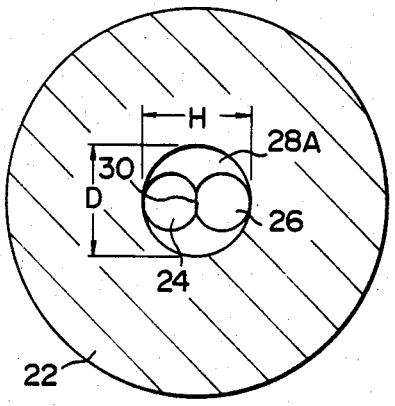
FIG. 2 is a sectional view taken along a line II—II in FIG. 1 where a meeting portion has a circular cross section.
Figure 3:
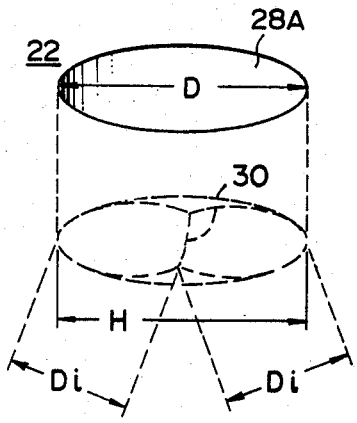
FIG. 3 is an oblique view of the meeting portion of FIG. 2.

FIGS. 2 and 3 show one embodiment of a meeting portion identified by reference numeral 28A. Meeting portion 28A of injected fuel paths 24 and 26 has a circular cross section with a diameter D which is not smaller than the total corresponding transverse dimension H of walls of a plurality of injected fuel paths 24 and 26.

Figure 4:
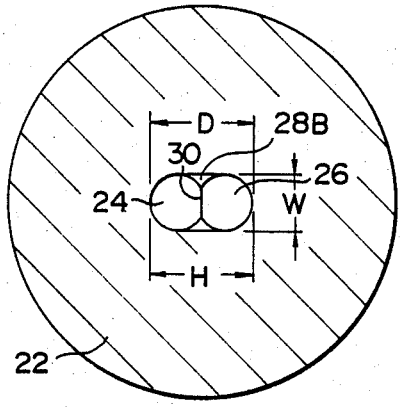
FIG. 4 is an sectional view taken along a line IV—IV in FIG. 1 where a meeting portion has an oblong cross section.
Figure 5:
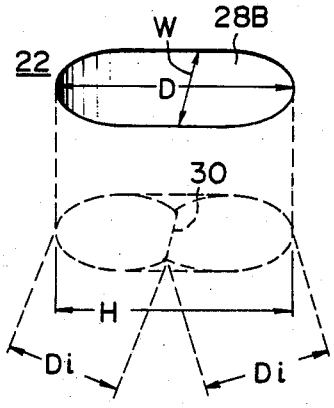
FIG. 5 is an oblique view of the meeting portion of FIG. 4.

FIGS. 4 and 5 show another embodiment of a meeting portion identified by reference numeral 28B. Meeting portion 28B of injected fuel paths 24 and 26 has an oblong cross section with a longitudinal inner transverse dimension D which is not smaller than the total corresponding transverse dimension H of the walls of a plurality of injected fuel paths 24 and 26 and a width W which is not smaller than the inner diameter Di of injected fuel paths 24 and 26.

Meeting portion 28 may be formed in the shape of meeting portion 28A or in the shape of meeting portion 28B.

Figure 8:
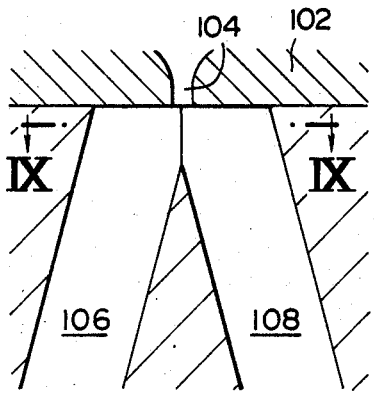
FIG. 8 is a partial sectional view of a meeting portion for comparison.
Figure 9:
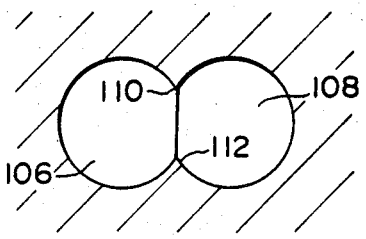
FIG. 9 is a sectional view taken along a line IX—IX of FIG. 8.
Figure 10:
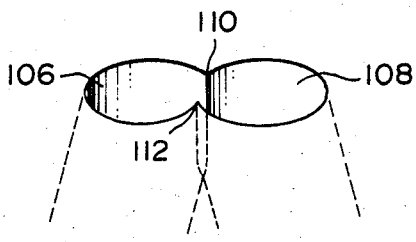
FIG. 10 is an oblique view of the meeting portion of FIG. 9.

FIGS. 8 to 10 show a fuel injection valve without a meeting portion 28, for comparison. The fuel injection valve 102 has a single fuel injection hole 104 and two injected fuel paths 106 and 108, but it does not have an enlarged space corresponding to meeting portion 28 of the present invention. In the fuel injection valve 102, the intersecting portions 110 and 112 of the walls of injected fuel paths 106 and 108 protrude significantly into the fuel path below fuel injection hole 104. Therefore, fuel injected from fuel injection hole 104 strikes against the protrusions 110 and 112 formed by the intersecting walls of injected fuel paths 106 and 108 and will be prevented from flowing smoothly. However, in the present invention, since meeting portion 28 with an enlarged space is located between fuel injection hole 14 and a plurality of injected fuel paths 24 and 26, fuel injected from fuel injection hole 14 does not impinge on such protrusions 110 and 112, and such interuption of smooth flowing does not occur.

Figure 11:
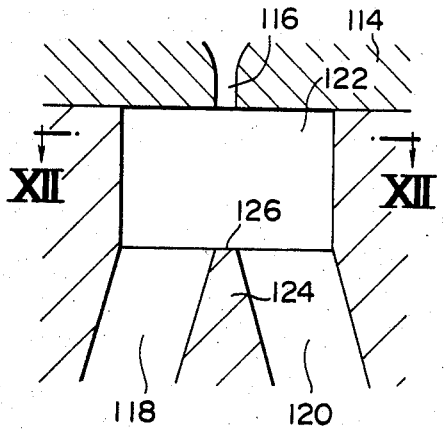
FIG. 11 is a partial sectional view of a meeting portion for another comparison.
Figure 12:
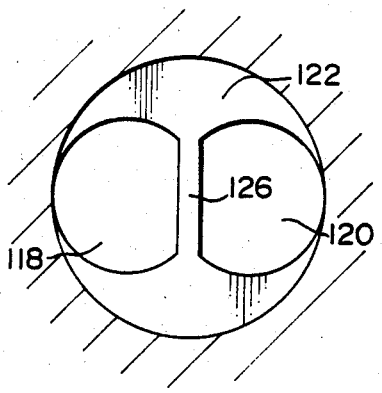
FIG. 12 is a sectional view taken along a line XII—XII of FIG. 11.
Figure 13:
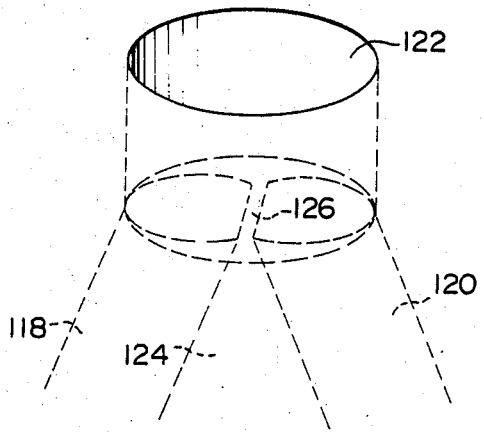
FIG. 13 is an oblique view of the meeting portion of FIG. 12.

FIGS. 11 to 13 show a fuel injection valve with too large a meeting portion, for another comparison. The fuel injection valve 114 has a single fuel injection hole 116 and two injected fuel paths 118 and 120. The fuel injection valve 114 has also an enlarged meeting portion 122 of injected fuel paths 118 and 120, but meeting portion 122 is too deep, so that an injected fuel dividing portion 124 formed by intersection of injected fuel paths 118 and 120 is cut by meeting portion 122 and has a machined flat plane 126 at its top which is located just below fuel injection hole 116. Therefore, fuel injected from fuel injection hole 116 hits against flat plane 126 and is prevented from flowing smoothly. However, since injected fuel dividing portion 30 of the present invention is just below fuel injection hole 14 and has a sharp edge, the fuel injected from fuel injection hole 14 is smoothly divided without hitting against a flat portion.

In fuel injection valve 2 of the present invention shown in FIGS. 1 to 7, fuel passes filter 16 and fuel supply path 18 to reach the fuel injection hole. When the fuel passes the fuel injection hole, it is accurately metered, and then it is injected into meeting portion 28. The fuel injected into meeting portion 28 flows smoothly through meeting portion 28 without colliding with any protruding wall of meeting portion 28. When the fuel reaches injected fuel dividing portion 30, it is smoothly divided by the sharp edge of injected fuel dividing portion 30 without impinging against any flat portion and flows into injected fuel paths 24 and 26. The fuel injected into injected fuel paths 24 and 26 flows through injected fuel paths and flows into the divided intake path portions of an intake path of an internal combustion engine having a plurality of intake valves.

Figure 1:
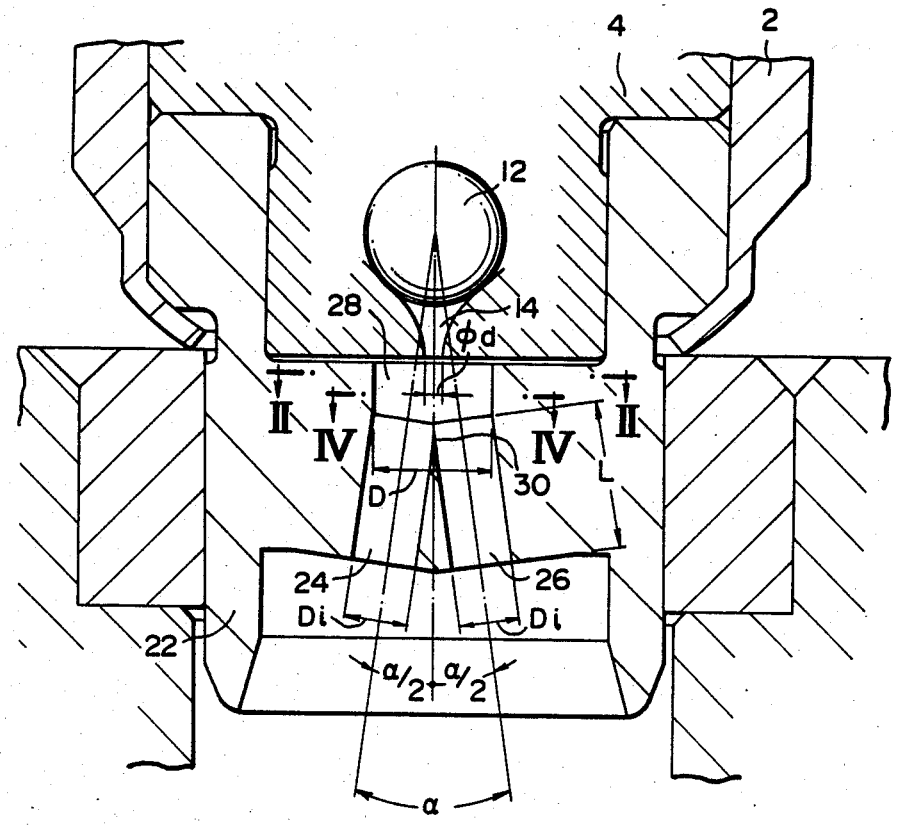
FIG. 1 is a sectional view of a fuel outlet portion of an electromagnetic fuel injection valve in accordance with one embodiment of the present invention.

Next, desirable relationships among a length (L) of injected fuel paths 24 and 26, an equivalent diameter (Di) of injected fuel paths 24 and 26, and diameter (d) of fuel injection hole 14 will be explained, referring to FIG. 1. These structural dimensions are set as follows:

$$30 \geqq n(Di/d)^2 \geqq 20$$

$$3 \geqq L/Di \geqq 1.$$

In this connection, the equivalent diameter (Di) means a diameter of a circular cross section having the same cross sectional area as the cross sectional area of an injected fuel path having a cross section other than a circle.

Figure 14:
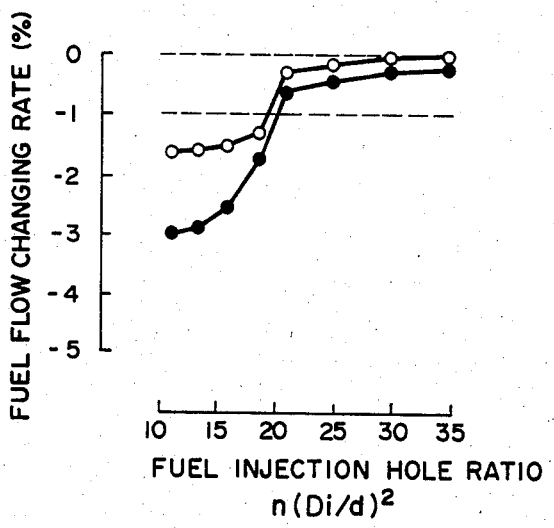
FIG. 14 is a diagram showing a relationship between fuel injection hole ratio $n(Di/d)^2$ and fuel flow changing rate (%)

The reasons why the above-mentioned relationships should be adopted are as follows:

FIG. 14 shows metering characteristics at high fuel temperatures and at vacuums in an engine intake path when fuel metering is most affected by ambient conditions. In the tests, the fuel temperature was set at 70° C. and the intake pressure was set at −380 mmHg. The test results are shown, plotting fuel injection hole ratio $n(Di/d)^2$ on the abscissa and flow change rate (%) on the ordinate, between a dynamic injection condition with fuel being injected at a frequency of 100 Hz with an injection pulse width of 5 m/sec and a static injection condition with fuel being constantly injected through a fully opened valve. In FIG. 14, the dynamic injection characteristics are shown by a line connecting black circles and the static injection characteristics are shown by a line connecting white circles. Usually, the above values take minus values, and inspite of minus values or plus values, the smaller the values are, the more accurate are the metering characteristics.

FIG. 14 shows results of a test executed using a two-path fuel injection valve (that is, $n=2$) having a dimensional ratio $(L/Di)=2.0$. As shown in FIG. 14, when $n(Di/d)^2=2(Di/d)^2$ is small, the fuel flow changing rate becomes large and exceeds a specified value, for example, of −1%. However, if $2(Di/d)^2$ is over 20, the fuel flow changing rate comes into a range whose deviation from 0 is smaller than the specified value of −1%. Therefore, when the injected fuel volume is 295 cc/min, the dimensions of $d=0.5$ mm and $Di=1.6$ mm satisfy the small fuel flow changing rate. When the relationship of $3 \geqq L/Di \geqq 1$ is met, the similar small fuel flow change rate is obtained.

Figure 15:
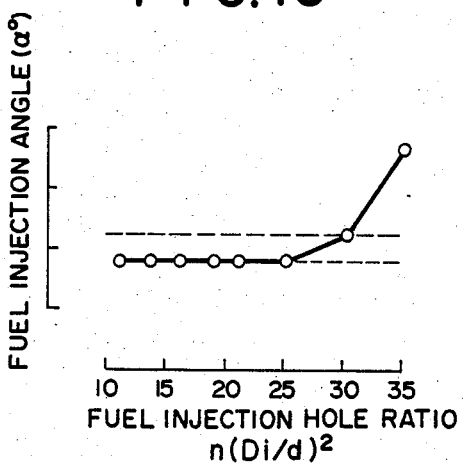
FIG. 15 is a diagram showing a relationship between fuel injection hole ratio $n(Di/d)^2$ and fuel injection angle $\alpha°$.

FIG. 15 shows a relationship between fuel injection hole ratio $(Di/d)^2$ and fuel injection angle ($\alpha$°) in the case of a two-way fuel injection valve, at an intake pressure of −500 mmHg. Usually, in a two-way fuel injection valve, fuel injected under atmospheric pressure can be aimed in specified directions determined by design, and the rate of fuel atomization is good. However, under a high vacuum of about −500 mmHg, the spreading angle of the injected fuel is apt to spread significantly, and the rate of fuel atomization becomes poor. This tendency conspicuously appears when $n(Di/d)^2$ exceeds 30. Therefore, if the equivalent diameter Di of the injected fuel paths 24 and 26 is set too large, fuel injection will deteriorate. From these considerations, the relationship of $30 \geqq n(Di/d)^2 \geqq 20$ is determined.

With respect to the relationship between the length (L) of injected fuel paths 24 and 26 and the equivalent diameter (Di) of each of injected fuel paths 24 and 26, when L/Di is small, that is, the path length L is comparatively small, the spreading angle of the injected fuel is apt to become larger than a specified value, which is predetermined by design, because the fuel tends not to flow along an injected fuel dividing portion. On the contrary, when L/Di is too large, that is, the equivalent diameter Di is comparatively small, fuel flow change rate is apt to become large with respect to $n(Di/d)^2$, because an injected fuel path with a small diameter becomes a kind of throttle. From these considerations, the relationship of $3 \geqq L/Di \geqq 1$ is determined.

Figure 16:
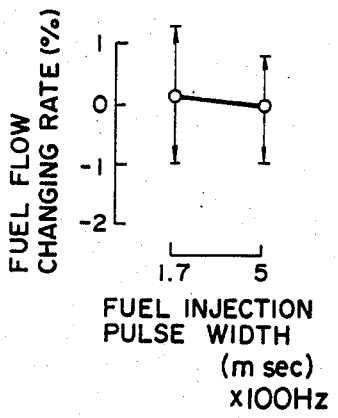
FIG. 16 is a diagram showing a relationship between fuel injection pulse width and fuel flow changing rate (%)

FIG. 16 shows results obtained in a test executed using ten fuel injection valves having the above-mentioned structural relationships, and setting a static fuel injection volume at 295 cc/min. As shown in FIG. 16, the fuel flow change rate, including fluctuations thereof is in the range of $\pm 1\%$. In this connection, Di is set at 1.9 mm and therefore, $2(Di/d)^2$ becomes 27.9.

In a fuel injection valve 2 having the above-mentioned structural relationships, the pressure in the intake path of the internal combustion engine can be transmitted to fuel injection hole 14, and the metering accuracy of the fuel can be maintained high in spite of variations of engine intake pressures and fuel temperatures.

Next, a relationship between the angle formed in the bottom surface of meeting portion 28 and the mounting angle at which fuel injection valve 2 is mounted on the internal combustion engine will be explained referring to FIGS. 17 to 20.

Figure 17:
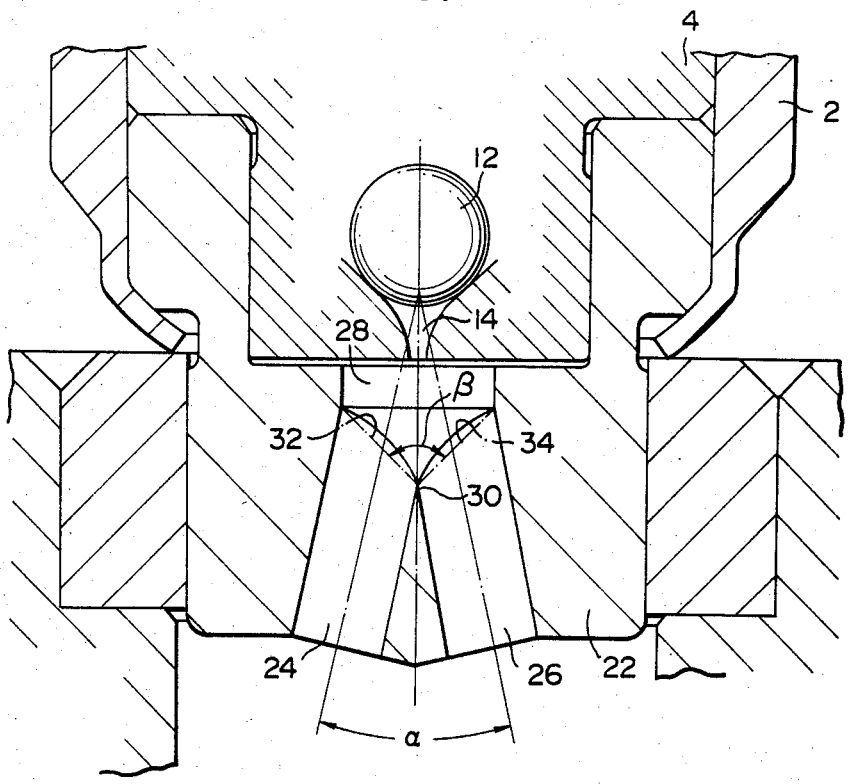
FIG. 17 is a partial sectional view of an electromagnetic fuel injection valve in accordance with another embodiment of the present invention.
Figure 18:
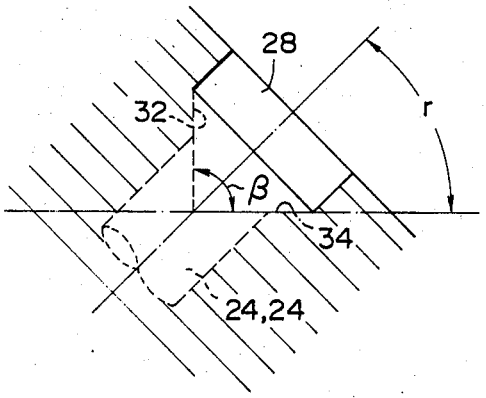
FIG. 18 is a partial sectional view of the fuel injection valve of FIG. 17 which is mounted on an internal combustion engine.

As shown in FIG. 17, an angle $\beta$ made in the bottom surface of meeting portion 28, that is, angle $\beta$ defined by a left bottom surface portion 32 and a right bottom surface portion 34 of the conical bottom surface in FIG. 17 is set not larger than twice an angle $\gamma$, with respect to the horizontal, at which fuel injection valve 2 is mcunted on the internal combustion engine 36 in FIG. 18. Fuel injection valve 2 is mounted on internal combustion engine 36 so that a plane including both axes of injected fuel paths 24 and 26 is inclined at an angle $\gamma$ with respect to the horizontal, as shown in FIG. 18.

In a fuel injection valve 2 thus mounted, bottom surface 32 or 34 of meeting portion 28 has a slope to let any fuel resting on bottom surface 32 or 34 flow toward injected fuel paths 24 and 26 by gravity, so the fuel tends not to stand on bottom surface 32 or 34. Therefore, a sudden outflow of standing fuel into the engine intake path by a blowing of injected fuel and air will not occur and a stable air/fuel ratio of an intake gas of an engine can be obtained.

Figure 19:
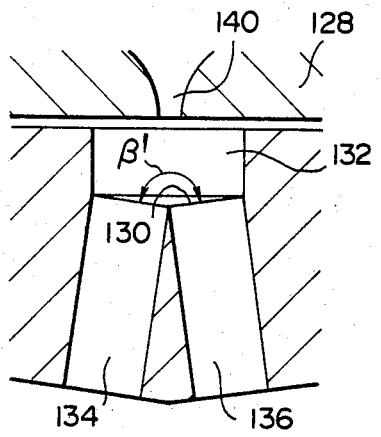
FIG. 19 is a partial sectional view of a fuel injection valve for comparison.
Figure 20:
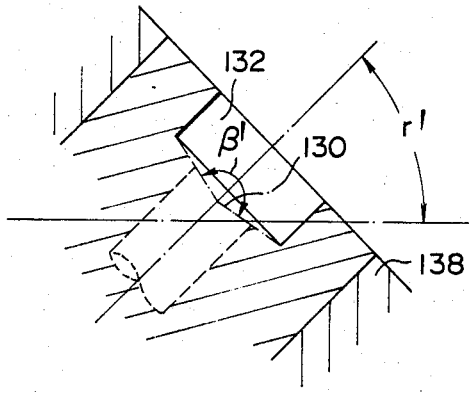
FIG. 20 is a partial sectional view of the fuel injection valve of FIG. 19 which is mounted on an internal combustion engine.

FIGS. 19 and 20 show a fuel injection valve 128 with an almost flat bottom surface, for comparison. In fuel injection valve 128, the angle $\beta'$ made in a bottom surface 130 of a meeting portion 132 of injected fuel paths 134 and 136 is set larger than twice the angle $\gamma'$, at which fuel injection valve 128 is mounted on an internal combustion engine 138. In this structure, fuel injected from a fuel injection hole 140 will stand on bottom surface 130 of meeting portion 132 and a sudden flowing of the standing fuel into the engine intake path will occur. On the contrary, according to the present invention, such standing of fuel on bottom surface 32 or 34 can be prevented.

Although only preferred embodiments of the present invention have been described in detail, it will be appreciated by those skilled in the art that various modifications and alterations can be made to the particular embodiments shown without materially departing from the novel teachings and advantages of the present invention. Accordingly, it is to be understood that all such modifications and alterations are included within the scope of the present invention as defined by the following claims.

What is claimed is:

1. An electromagnetic fuel injection valve adapted for mounting on an internal combustion engine, the injection valve comprising:

a valve body having a longitudinal axis and being formed with a single fuel injection hole for metering fuel to be injected;

a plurality of injected fuel paths provided downstream of said fuel injection hole, each of said injected fuel paths being inclined from the axis of said valve body and having a constant cross section over its entire length;

an injected fuel dividing portion provided downstream of said fuel injection hole, said injected fuel dividing portion having a sharp edge facing upstream and being formed by intersecting walls of said injected fuel paths; and a meeting portion of the injected fuel paths located downstream of said fuel injection hole and upstream of said injected fuel dividing portion, said meeting potion of the injected fuel paths being formed to have a constant cross section with an axis coinciding with said fuel injection valve body axis and including said cross section of each of said injected fuel paths therein, a wall of said meeting portion being formed to have an inner transverse dimension not smaller than a total corresponding transverse dimension of walls of said plurality of injected fuel paths, wherein a length (L) of each said injected fuel paths, an equivalent diameter (Di) of each of said injected fuel paths, a diameter (d) of said fuel injection hole and a number (n) of said injected fuel paths have the following relationships:

$$30 \geqq n(Di/d)^2 \geqq 20$$

and $$3 \geqq L/Di \geqq 1.$$

2. The electromagnetic fuel injection valve for an internal combustion engine of claim 1, wherein said meeting portion of the injected fuel paths is formed to have a circular cross section having a diameter not smaller than the total corresponding transverse dimension of the walls of said plurality of injected fuel paths.

3. The electromagnetic fuel injection valve for an internal combustion engine of claim 1, wherein said meeting portion of the injected fuel paths is formed to have an oblong cross section having a maximum dimension not smaller than the total corresponding dimension of the walls of said plurality of injected fuel paths and a width not smaller than a diameter of each of said injected fuel paths.

4. The electromagnetic fuel injection valve for an internal combustion engine of claim 1, wherein said injected fuel dividing portion is curved in a longitudinal direction of said injected fuel dividing portion and both longitudinal ends of said injected fuel dividing portion terminate at a bottom surface of said meeting portion of the injected fuel paths.

5. The electromagnetic fuel injection valve for an internal combustion engine of claim 1, wherein the number of said injected fuel paths is two.

6. The electromagnetic fuel injection valve for an internal combustion engine of claim 1, wherein said injected fuel paths have circular cross sections.

7. An electromagnetic fuel injection valve adapted for mounting on an internal combustion engine, the injection valve comprising:

a valve body having a longitudinal axis and being formed with a single fuel injection hole for metering fuel to be injected;

a plurality of injected fuel paths provided downstream of said fuel injection hole, each of said injected fuel paths being inclined from the axis of said valve body and having a constant cross section over its entire length;

an injected fuel dividing portion provided downstream of said fuel injection hole, said injected fuel dividing portion having a sharp edge facing upstream and being formed by intersecting walls of said injected fuel paths; and a meeting portion of the injected fuel paths located downstream of said fuel injection hole and upstream of said injected fuel dividing portion, said meeting portion of the injected fuel paths being formed to have a constant cross section with an axis coinciding with said fuel injection valve body axis and including said cross section of each of said injected fuel paths therein, a wall of said meeting portion being formed to have an inner transverse dimension not smaller than a total corresponding transverse dimension of walls of said plurality of injected fuel paths, wherein said meeting portin of the injected fuel paths has a conical bottom surface with an axis coinciding with said axis of said fuel injection valve body, and wherein an angle made in said cone bottom surface of said meeting portion of the fuel injected fuel paths is not larger than twice an angle, with respect to the horizontal, at which said fuel injection valve is mounted on said internal combustion engine.

* * * * *

UNITED STATES PATENT AND TRADEMARK OFFICE

CERTIFICATE OF CORRECTION

PATENT NO. : 4,657,189

DATED : April 14, 1987

INVENTOR(S) : M. Iwata, et al.

It is certified that error appears in the above-identified patent and that said Letters Patent is hereby corrected as shown below:

Column 1, line 7, after "Invention" insert --:--.

Column 1, line 11, after "Prior Art" insert --:--.

Column 2, line 21, change "in a bottom" to --in the bottom--.

Column 4, line 62, change "Meeting" to --The meeting--.

Column 7, line 24, after "thereof" insert a comma.

Column 8, line 63, change "not" to --no--.

Column 7, line 44, change "mcunted" to --mounted--.

Column 10, line 15, change "portin" to --portion--.

Signed and Sealed this

Twenty-seventh Day of October, 1987

*Attest:*

DONALD J. QUIGG

*Attesting Officer*

*Commissioner of Patents and Trademarks*